US009799207B1

(12) United States Patent
Tavares

(10) Patent No.: US 9,799,207 B1
(45) Date of Patent: Oct. 24, 2017

(54) PREFERENCE BASED MASS NOTIFICATION SYSTEM

(71) Applicant: David Tavares, Kleinburg (CA)

(72) Inventor: David Tavares, Kleinburg (CA)

(73) Assignee: Globestar Systems Inc, Toronto (CA)

( * ) Notice: Subject to any disclaimer, the term of this patent is extended or adjusted under 35 U.S.C. 154(b) by 0 days.

(21) Appl. No.: 15/088,245

(22) Filed: Apr. 1, 2016

(51) Int. Cl.
*G08B 1/08* (2006.01)
*G08B 27/00* (2006.01)
*G08B 25/10* (2006.01)

(52) U.S. Cl.
CPC ..... *G08B 27/001* (2013.01); *G08B 25/10* (2013.01)

(58) Field of Classification Search
CPC .... G08B 25/10; G08B 25/016; G08B 25/007; G08B 25/003; G08B 25/014; G08B 27/007; G08B 27/001; H04M 2203/2016; H04M 3/46; H04M 2242/04; H04M 2242/02; H04M 3/5116; G06F 17/30867; H04L 12/587; H04L 51/24; H04H 20/71; H04H 20/59; H04W 76/007; H04W 4/06; H04W 4/22
USPC ..... 340/539.1, 539.13, 539.11, 541, 573.1; 455/404.1, 521
See application file for complete search history.

(56) References Cited

U.S. PATENT DOCUMENTS

| | | | | |
|---|---|---|---|---|
| 6,842,628 | B1 * | 1/2005 | Arnold | H04L 12/587 455/556.2 |
| 7,509,304 | B1 * | 3/2009 | Pather | G06F 17/30867 |
| 7,697,922 | B2 * | 4/2010 | McQuaide, Jr. | H04L 12/58 455/412.1 |
| 2002/0042846 | A1 * | 4/2002 | Bottan | H04L 29/06 709/249 |
| 2006/0111092 | A1 * | 5/2006 | Harris | H04M 3/46 455/418 |
| 2015/0058250 | A1 * | 2/2015 | Stanzione | G06Q 10/0637 705/342 |

* cited by examiner

*Primary Examiner* — Anh V La
(74) *Attorney, Agent, or Firm* — Robert Schuler

(57) ABSTRACT

An event notification system is configured with a record for each one of a plurality of individual responders to a mass notification event. Each record can have preference information that is specified by an individual responder associated with the record, and the event notification system can use the preference information to generate, for each of the individual responders, a single mass notification message that is formatted according to the preferences of each individual responder.

18 Claims, 8 Drawing Sheets

FIG. 6

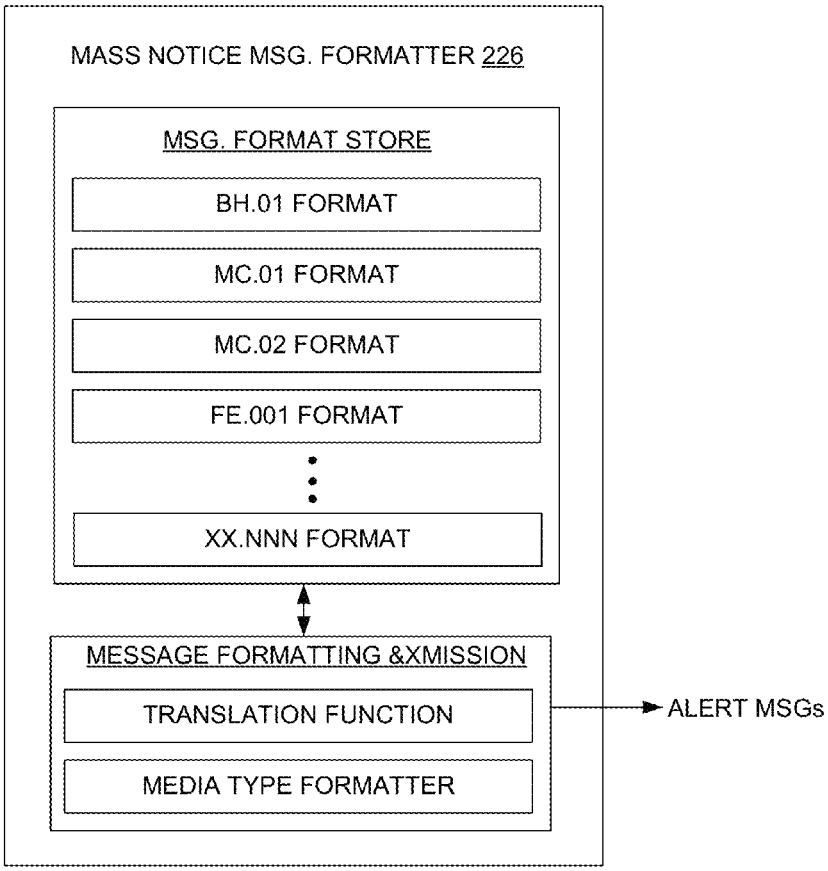

FIG. 7

TEXT ALERT MESSAGE

TO: GROUP ER.01
FM: HOSPITAL ABC EMERGENCY ADMIN.
EVENT TYPE; MASS CASUALTY
ALERT DETAILS: THERE HAS BEEN AN ACCIDENT @ XYZ LOCATION INVOLVING A TRAIN AND A BUS; THE ACCIDENT OCCURRED AT 10:30PM; 50 VICTIMS OF THE ACCIDENT ARE BEING TRANSPORTED TO ABC EMERGENCY ROOM; THE VICTIMS HAVE MULTIPLE TRAMAS INCLUDING, FRACTURES, CONCUSSIONS, LOSE OF BLOOD, ETC.; ALL MEMBERS OF ER.01 REQUESTED TO REPORT ASAP.

PREFERENCE BASED MASS NOTIFICATION SYSTEM

1. FIELD OF THE INVENTION

The present disclosure relates to sending a similar message to a plurality of different individuals where at least some of the content comprising each message is generated based upon an individual profile.

2. BACKGROUND

Resolving certain types of emergency events can necessitate the involvement of a large number of individuals. A mass casualty event, building fires or other types of fire emergencies, building evacuation event, bio-hazard event, weather disaster event, or any other type of event affecting a large number of people or a large geographic area that requires a large number of individuals be alerted to or notified of the event occurrence. Depending upon the event type, different individuals or groups of individuals can be alerted to the event. These individuals may be members of a group or not members of a group, these individuals may be members of a group trained to handle such events, or these individuals may be a member of a group that isn't trained to handle such events, such as the occupants of a building. Such an alert is typically referred to as a mass notification message. The content of a mass notification message can vary depending upon the type of event, but generally such a message can include the type of event, the time of the event, the location of the event, instructions to those who are alerted to respond to the notice in some manner, and the message can include information descriptive of the event that may be of use to the responders.

Systems are known that operate to generate and send mass notification messages to a large number of individuals, to all individuals in a particular group, or to some specified individuals who are members of the particular group. Some of these systems operate to send a single mass notification message in multiple different languages, and other systems operate to send a sequence of similar mass notification messages to the same individuals, with each message in the sequence only differing by the language of the message. So for instance, a first message in a sequence can be in English, a second message in the sequence can be in Spanish, and a third message in the sequence can be in Chinese, and each of the individuals will receive all of the messages in the sequence. Other systems are known that operate to only send mass notification messages to individuals who specifically request to receive certain types of messages, or that operate to send messages via a preferred contact method (i.e., a phone call, text message. electronic mail, etc.).

3. BRIEF DESCRIPTION OF THE DRAWINGS

FIG. 6 is a diagram illustrating elements comprising a mass notice message formatter 226 comprising the ENS 20.

FIG. 7 is an example of content comprising a mass alert message.

4. DETAILED DESCRIPTION OF THE DRAWINGS

While current mass notification systems can operate to deliver alert or notification messages in multiple different languages, or operate to only deliver messages to individuals who prefer to receive messages of a particular type and via a preferred contact method, these systems are limited in as much as they transmit an unnecessary number of messages (i.e., sequential notification messages in different languages) to each individual, and these systems are not able to operate to deliver similar types of mass notification messages with different content according to individual preferences.

Accordingly, we have designed a mass alert/notification messaging system that operates, according to one embodiment, to only transmit a single notification message to some or to all of a plurality of individuals that only has content selected by each individual. The mass notification/alert message system comprises separate records having information relating to each of the plurality of the individuals. Each record is comprised of personal information corresponding to each individual and preference information. Each individual can selectively create and edit their preference information, and the selected content preferences can include, but are not limited to, a preferred language, a preferred alert device, contact number or address, a preferred alert media type, a preference as to whether or not an individual wants the system to consider their current location and/or alert device location when generating and transmitting an notification/alert message, and other selected preferences. The novel mass notification/alert message system can be implemented in an Event Notification System (ENS), such as an ENS 20 shown with reference to FIG. 1. In another embodiment, the ENS 20 can operate to detect a current duty status of an individual and use this information to determine whether to notify/alert the individual or not. In another embodiment, the ENS 20 can operate to detect a current location and motion of an alert device, and then use this information to determine the media type of the alert message. Throughout this description, the terms alert and notification are used interchangeably, and both terms have the same meaning.

Figure 1:
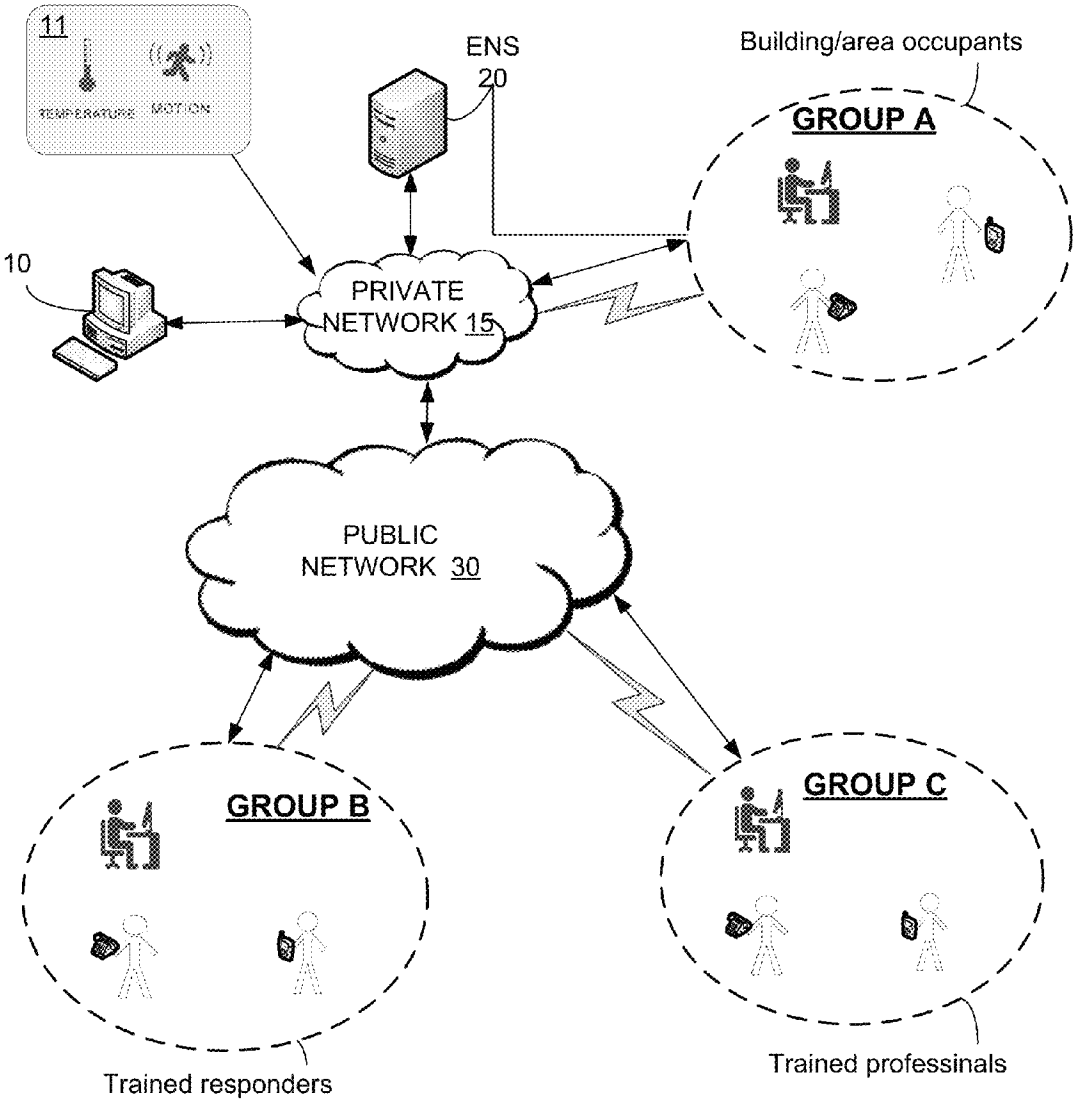
FIG. 1 represents a communication network topology over which a mass alert message can be transmitted.

These and other embodiments are described with reference to the figures, in which FIG. 1 generally illustrates a communication network topology that has a private network 15 connected to a public network 30. The private network can be implemented in any appropriate type of local area network (i.e., WiFi, Ethernet), and the public network 30 can be implemented in an appropriate wide area network technology (i.e., Internet, POTS, Cellular). Regardless of the technology employed to implement these networks, the private network 15 operates to pass messaging information from event message generation devices to the ENS 20. Event messages can be generated automatically or manually, depending largely upon the type of event and the type of device that detects the event. For example, if a system administrator becomes aware of a mass casualty event, they can use a communications device 10 to manually select and send an event message, or an event sensor 11, such as a smoke or temperature detector or a security system/motion detector, can sense an event and automatically generate and send and alarm over the network 15 to the ENS 20. Regardless of the means by which an event is detected, and regardless of the mean by which an event message is generated and sent, the ENS 20 generally receives these event messages, assigns a unique message identifier to each message, and determines what type of message it is (regular or mass event type message), and processes each type of message in a different manner. Assuming that the ENS 20 determines that a message it receives is a mass event type message, it examines the message for mass event type information and for any other information (special instructions) included with the message that can be used to determine to which plurality of individuals a mass alert message should be sent. Pertinent information detected in a mass event message is maintained in a mass event message processor store associated with the ENS 20. When new mass event message information is detected in the store, it is used to determine which of a plurality of individuals should receive a corresponding mass alert message, and the information is used to identify individual preferences that can, among other things, determine what type of content to include in the message.

One or more similar mass alert messages are generated and sent by the ENS 20 over the private, or private and public networks to some or all of the plurality of the individuals. As described earlier, the plurality of the individuals can be members of a group (medical doctors assigned to an ER, nurses assigned to trauma unit, fire fighters or other emergency or police units assigned to a particular location), or the plurality of the individuals may not be members of a group. FIG. 1 shows three different groups of individuals, notification Group A, Group B and Group C, any one or more of the plurality of the individuals comprising each group can be identified to receive a mass alert message. Group A can be comprised of individuals who are on duty and located in proximity to an event or merely individuals who are occupants of a building, such as in the same building or group of buildings. Groups B and C can be comprised of individuals who are not located proximate to an event. Each group can be comprised of individuals who are qualified to respond to a particular type of event, such as a fire emergency, medical emergency or a security emergency, and an individual who is assigned membership in one group can be a member of one or more other, different groups.

Figure 2:
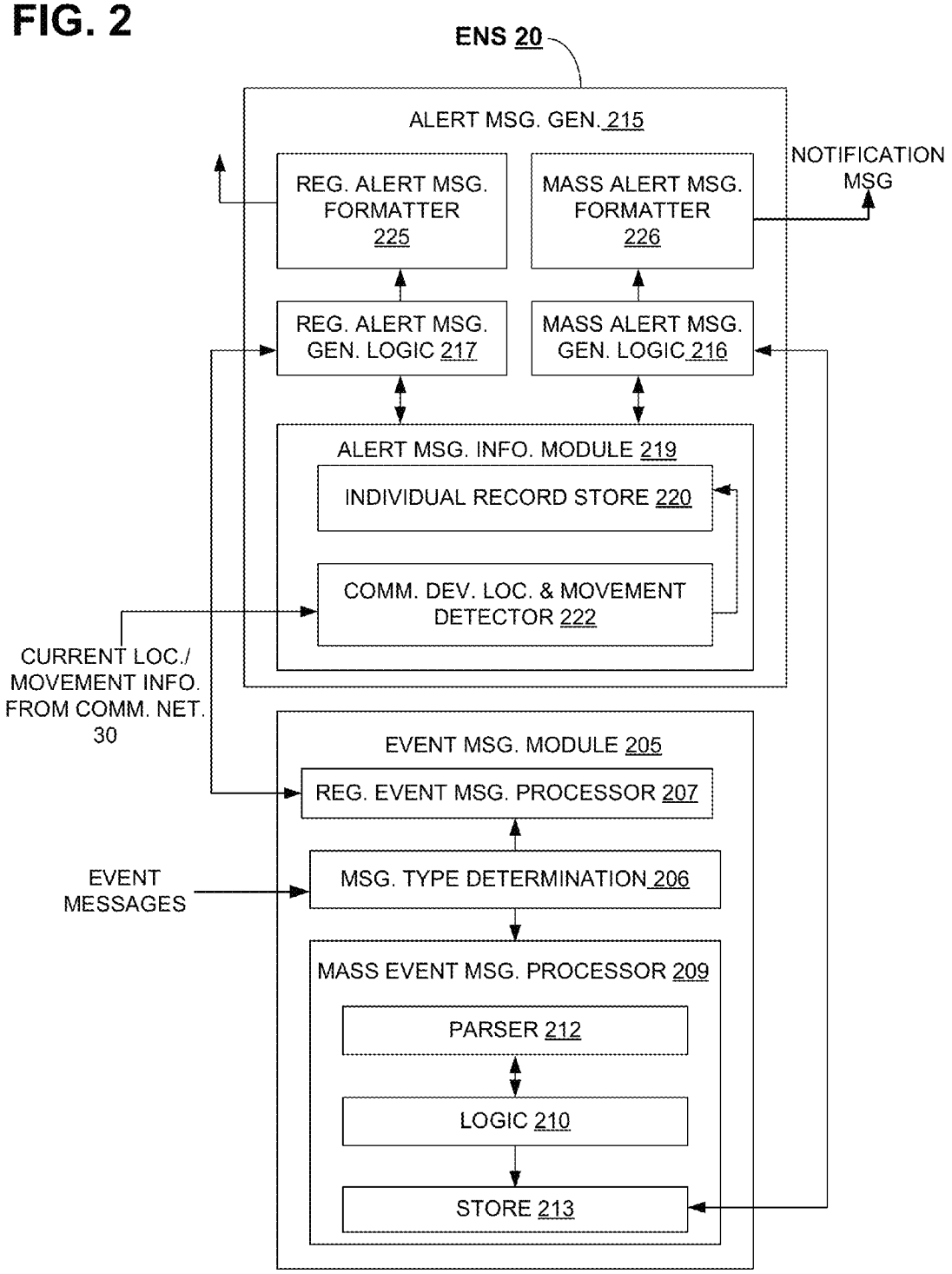
FIG. 2 is a diagram illustrating functional elements comprising an Event Notification System (ENS) 20.

FIG. 2 is a diagram showing functional elements comprising the ENS 20. The design and operation of an event notification system is well known, and so only those functional elements that may be needed to process mass event messages and to generate mass event messages will be described here. In this regard, the ENS 20 has, among other things, an alert message generation module 215 and an event message module 205. The event message module 205 operates to receive all types of event messages from event message generation devices, and has a message type determination function 206, a regular event message processor 207 and a mass event message processor 209. The message type determination function 206 examines each received event message to determine whether the message is a regular event message type or a mass event message type. The determination function 206 operates to assign a unique event message identifier to each received event message, and passes all mass event messages to a mass event message processor 209, where a parser 212 operates to detect one or more types of information comprising each message. For example, the parser can examine each message to detect information corresponding to a mass event type, and for any special instructions in the message that the ENS 20 can be used by the individuals to aid them in their response. The parsed information can be operated on by logic 210 to determine the type of each mass event message (fire, casualty/medical, security, etc.), and after determining what the message type is, the logic can assign a unique mass event code to the message information. The table of mass event message types and corresponding mass event codes can be maintained in the ENS 20 in association with the logic 210. The unique message identity, the mass event type code, the special event message instructions, and other information can be maintained in a record instance identified by the unique event message identifier, and the record instance can be maintained a store 213.

The alert message generation module 215, referred to earlier, has among other things a mass alert message formatter 226, it has mass alert message generation logic 216, and it has an alert message information module 219 that is comprised of an a personnel record store 220 and a communication device location and movement detector 222. The personnel record store 220 is comprised of a plurality of separate records, with each record having information corresponding to a different one of a plurality of r individual responders. Each record in the store 220 can be labeled with the mass event type code assigned by the logic 210. Each record has information associated with a one individual responder, and this record information can include personal information about the individual, such as the individuals name, organization, job title and/or job description, and this record information can include preference information selected by the individual. This preference information can be comprised of a preferred notification language, preferred contact information (i.e., phone numbers, email addresses), preferred communication device(s) to which an alert is sent based upon a work status criteria or based upon a current location or movement (maintained in the record) of the communication device, and a preferred alert message content type (text, audio, video, mixed media, intercom, etc.). In the event that an individual does not specify any preference information, the preferences in their record can comprise default preferences that are configured by a system administrator, for instance. The communication device location and movement detector 222 operates to receive position information for a GPS or IPS function, it operates to receive movement information from an accelerometer function operating on a mobile device under the control of an individual, and it also operates to store the location and movement information in a personnel record maintained in the store 220.

The module 215 generally operates to generate mass alert messages having content that is tailored to one or more of a plurality of individuals, or to individual members of a notification group, such as any of the notification groups, Group A, B or C, and it operates to transmit the mass alert messages to some or all of the individuals. More specifically, the logic 216 running in the alert message generation module 215 can operate to periodically check the record instances maintained in the store 213 for new mass event messages (records labeled with new unique message identifier), and examines the event type code maintained in the new message record to identify the type of mass event to which the message corresponds. The logic 216 can use the event type code as a pointer to all individual records in the store 220 of personnel records maintained in the alert message information module 219. Each record that is identified has the contact information and the name of an individual to which an alert message can be transmitted. The logic can then operate in conjunction with the mass alert message formatter 226 on the information maintained in the individual record to generate a message that comprises content that is specifically tailored for the individual corresponding to preferences selected and maintained in the personal record. Once an alert message is formatted, it can then be sent to the individual associated with the record. The operation of the ENS 20 to process mass event messages and to generate mass alert messages is described in more detail with reference to the remaining figures.

Figure 3A:
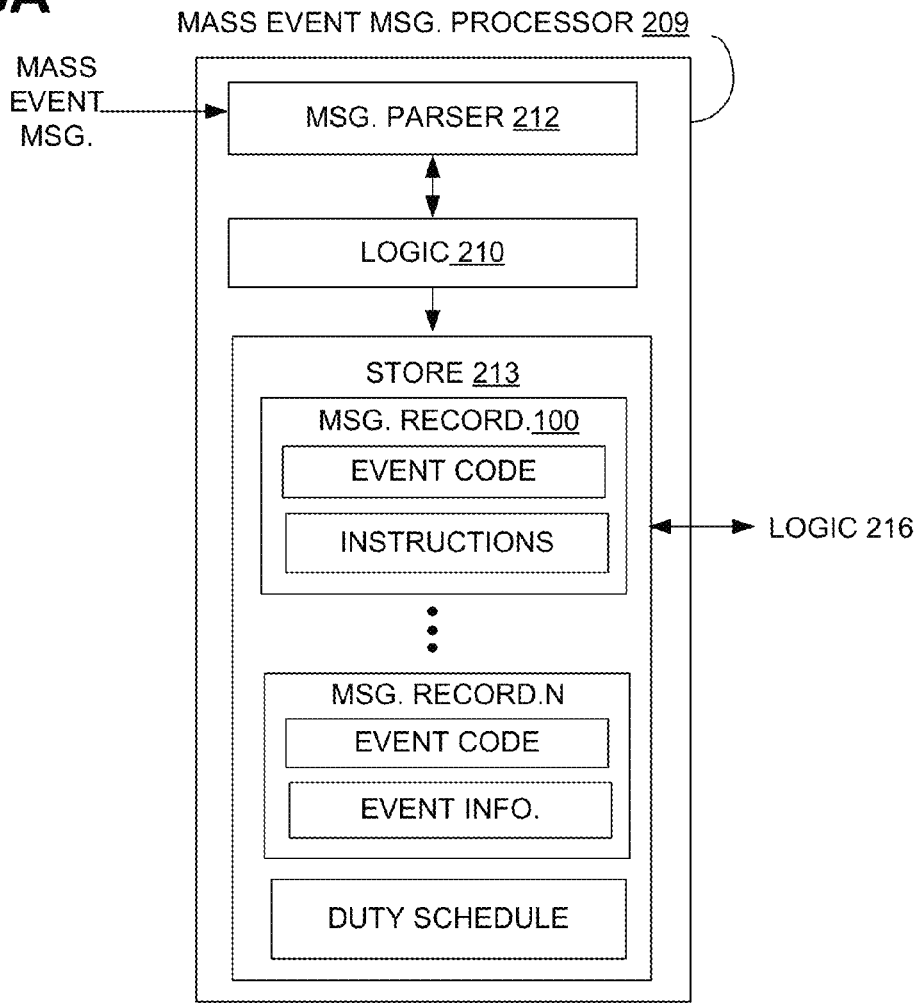
FIG. 3A is a diagram illustrating the functional elements comprising a mass event message processor 209 comprising the ENS 20.

Referring now to FIG. 3A, the mass event message processor 209 receives a message that has been determined, by the message type determination module 206, to be a mass event type message, and as previously described, the parser 212 (comprising the processor 209) operates to detect one or more particular types of information in the message (i.e., unique msg. ID assigned by the module 206, mass event type, and any other information in the message that can be used to generate an event message or to inform a responder as to the nature of an event, or to require a responder to acknowledge the notification/alert message and to indicate their availability to respond, or the message could include instructions used by the ENS 20 to track the number of available responders and include a threshold value that when met would trigger the ENS to cancel a notification message the ENS generates). The parsed mass event message information is examined by the logic 210 for information relating to a mass event type, and any other information that can be used to generate a mass alert message. Each mass event type corresponds to one or more mass event type codes that are stored in association with the module 205. For example, a mass casualty event can be assigned a type code MC.01, a fire evacuation event can be assigned a type code FE.001, and so forth. The logic 210 examines the mass event type information to determine the event type, and assigns an appropriate event type code which is placed into a record created to maintain the parsed message information. Each mass event type can be assigned any one of a number of different codes depending upon additional information in the mass event message. For example, a fire evacuation event message can include the name or location of a building or buildings to be evacuated, and a different event code (FE.001, FE.002, or FE.003) can be assigned to the event depending upon the buildings to be evacuated. A store 213 maintains separate records, Record.100 to Record.N, and as described previously, each record is populated with information parsed from a mass event message. In this regard, the Record.100 has event code information, which is a code corresponding to a particular mass event type, and it has other event information that is in some manner description of the mass event and can be included in a mass alert message sent to a responder, or which can be used to filter or specify those individuals who should be sent alerts to respond.

Figure 3B:
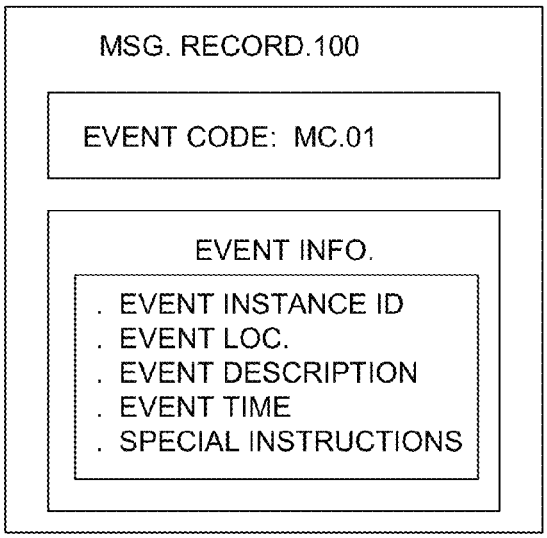
FIG. 3B shows an instance of an event record, Record.100, comprising a store 213 of records 213.

FIG. 3B shows the Record.100 described above in more detail. In this case, the Record.100 is assigned an event code MC.01, and the event information is comprised of a unique event instance identity assigned by the determination module 206, it has information that is descriptive of the geographic location of the event, it has information that is descriptive of the event, it has the time of the event occurrence, and it has special instructions that, for example, can prioritize the sequence in which particular teams of individuals should be notified.

Figure 4:
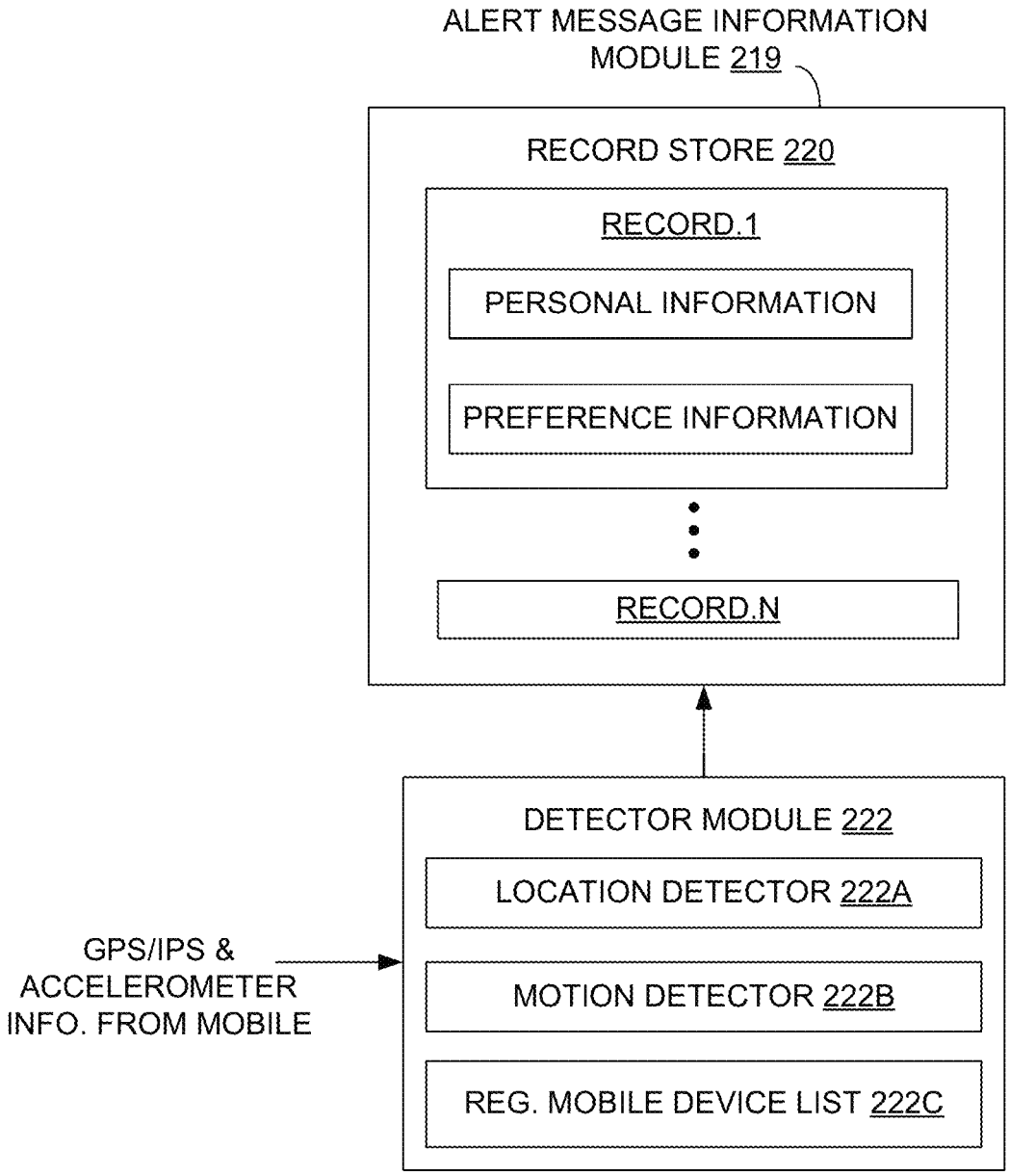
FIG. 4 is a diagram showing an alert message information module 219 comprising the ENS 20.
Figure 5:
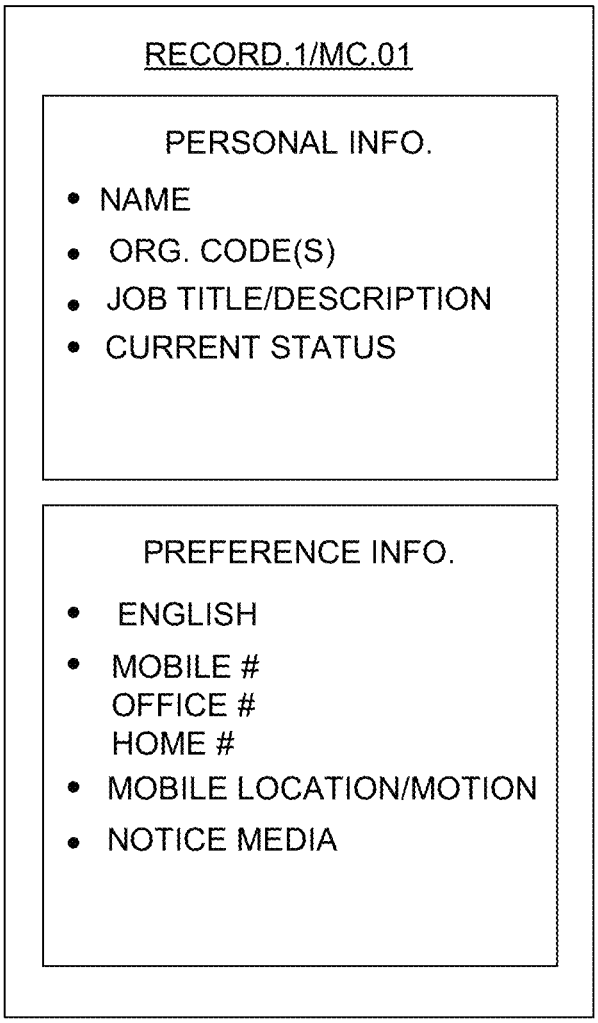
FIG. 5 is a diagram showing an instance of a record, Record.1/MC.001, comprising a record store 220 in the ENS 20.

As described earlier with reference to FIG. 2, the alert message generation module 215 generally operates to format mass alert messages having content that is tailored to one or more of a plurality of individuals, and it operates to transmit the mass alert messages to some or all of the individuals. FIG. 4 shows the alert message information module 219 having a store 220 of individual responder records, and each record can have personal information and preference information that is operated on by the logic 216 to determine how to format an alert message. FIG. 4 also shows a detector module 222 having a location detector 222A, a motion detector 222B and a registered mobile communication device listing 222C. Location and motion information received from each registered device in the list 222C can be sent to the appropriate record in the store 220 where it is maintained for later use. FIG. 5 is a diagram showing items comprising responder personal information and responder selected preferences in the record labeled RECORD.1 which is assigned a mass event code MC.01. RECORD.1 has, among other things, the name of an individual responder, a code or codes associated with an organization to which the individual responder is assigned/works for, is can have a job title and job description, and it can have the current duty status of the individual responder. The individual responder preferences comprise content that can include, among other things, a preferred language in which an alert message should be formatted (which in this case is English), it can have a preferred mobile number, office number, home number to which an alert message should be sent, it has a preference that can be selected to send alert messages to a particular device depending upon the location and motion of the device, and it has a preferred type of media content or contents in which an alert message should be formatted, and it can have an escalation sequence that specifies to what devices an alert message should be sent.

As described above, the logic 216 operates on information comprising one or more records in the store 220 in order to determine which individuals should receive an alert message and to determine how the alert message is formatted. The mass notification message formatter 226 shown in FIG. 6 has a store of message formats which can be selected by the logic 216 as a template used to generate a mass alert message. The store can has a different alert message format for each different type of mass event type, as determined by a mass event code assigned to a mass event message by the event message module 205. The formatter 226 also has a message formatting and transmission module that is comprised of a translation function or engine and a media type formatter.

In operation, the logic 216 periodically examines the store 213 of event record instances, comprising the event message processor 209, to identify new mass event messages, and to examine each new message for a mass event code, which in this case is MC.01. The logic then uses this event code as a pointer into the record store 220 to identify all of the individuals to which an alert message should be transmitted. In this case, all of the individuals with records that are labeled MC.01 are identified as those who an alert message should be transmitted. After identifying the appropriate individual records, the logic 216 selects an appropriate mass alert message format (in this case MC.01) to use to generate an alert message to each identified individual. The logic 216 then instructs the message formatter to incorporate mass event information in a mass alert message according to the preferences of each identified individual. Such a formatted mass alert message is described with reference to FIG. 7.

FIG. 7 shows a mass alert message that is formatted, according the preferences selected by an individual, and in this case the individual prefers to receive an alert message in the English language, prefers to receive alert messages in a textual format, and prefers that the message be sent password protected. In this case, the alert message can be formatted as an electronic message and transmitted securely over the Internet to the individual.

Figure 8A:
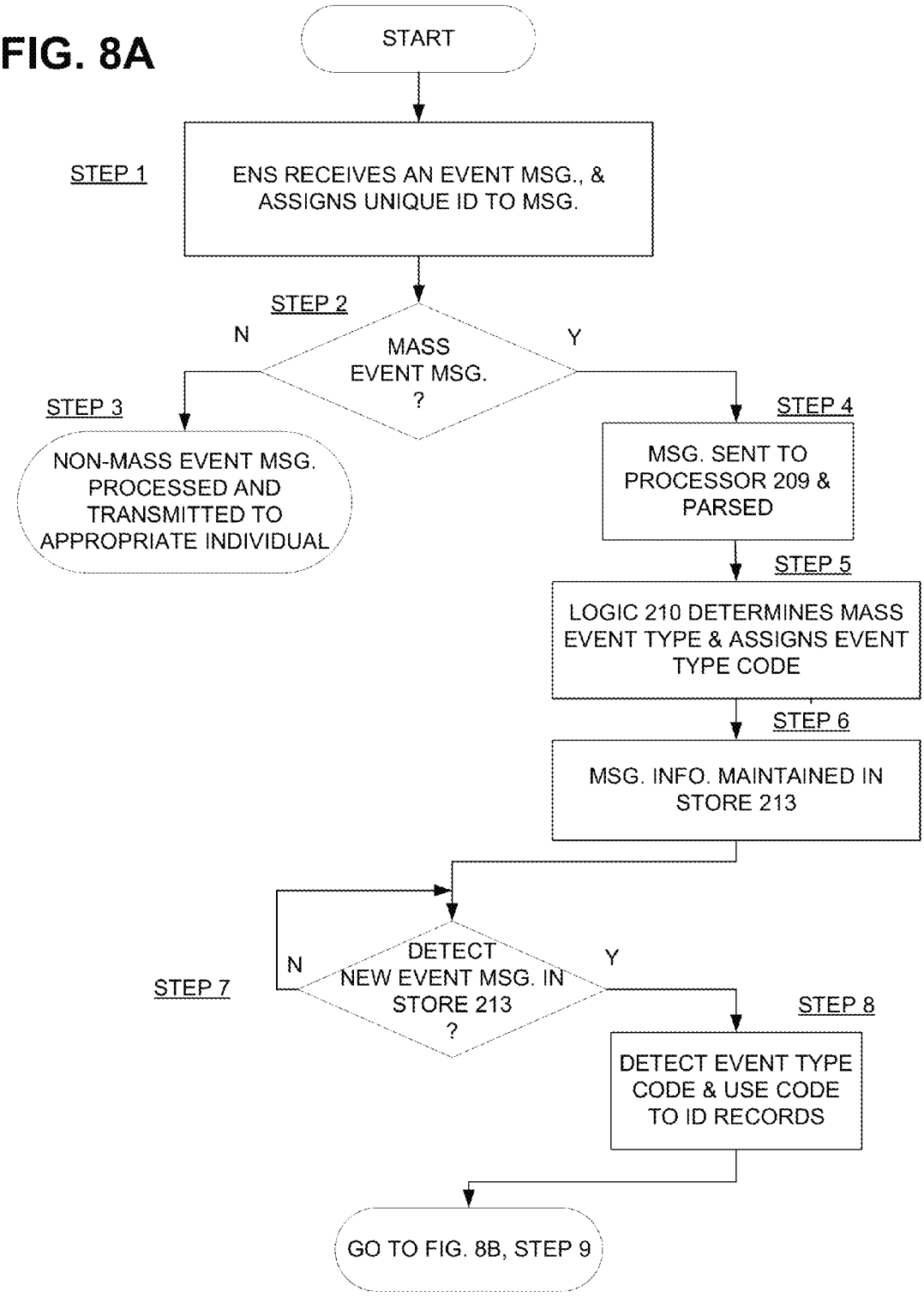
FIGS. 8A and 8B illustrate a logical process that can be employed by the ENS 20 to generate and transmit a mass alert message.

The operation of the ENS 20 and the logic 210 to identify certain information comprising a mass event message, and the operation of the logic 216 to control the formatting of an alert message is now described with reference to FIGS. 8A and 8B. Referring to FIG. 8A, in Step 1 the ENS 20 receives an event message from an event message generation device (i.e., fire alarm intrusion alarm) or from an organization (i.e., police department, department or some other emergency response department), and in Step 2 the ENS 20 determines whether the message is a mass event or not a mass event (regular) message. In the case that the ENS detects a mass event message, the process proceeds to Step 4 where the message is parsed for the different types of information comprising the message. For example, the parser 212 operates to detect, among other things, message information corresponding to the mass event message type, a unique message identity, an event location and description, an event time, and any special instructions comprising the message. Then, in Step 5 the logic 210 examines the parsed mass event type information to identify a mass event type, and uses the mass event type to look up (in the table associated with the logic 210 described earlier with reference to FIG. 2) and to assign a mass event type code to the message (the mass event type code in this case can be MC.01). Then in Step 6, the parsed message information and the associated code is maintained in the store 213. The logic 216 periodically examines the store 213 for new event messages, and if in Step 7 the logic detects a new event message the process proceeds to Step 8, otherwise the process loops on Step 7. The logic 216 examines each record in the store 220 for an event code (MC.01) that is the same as the code assigned in Step 5, as the result of this step, a listing of records can be created and temporarily stored in association with the logic.

Figure 8B:
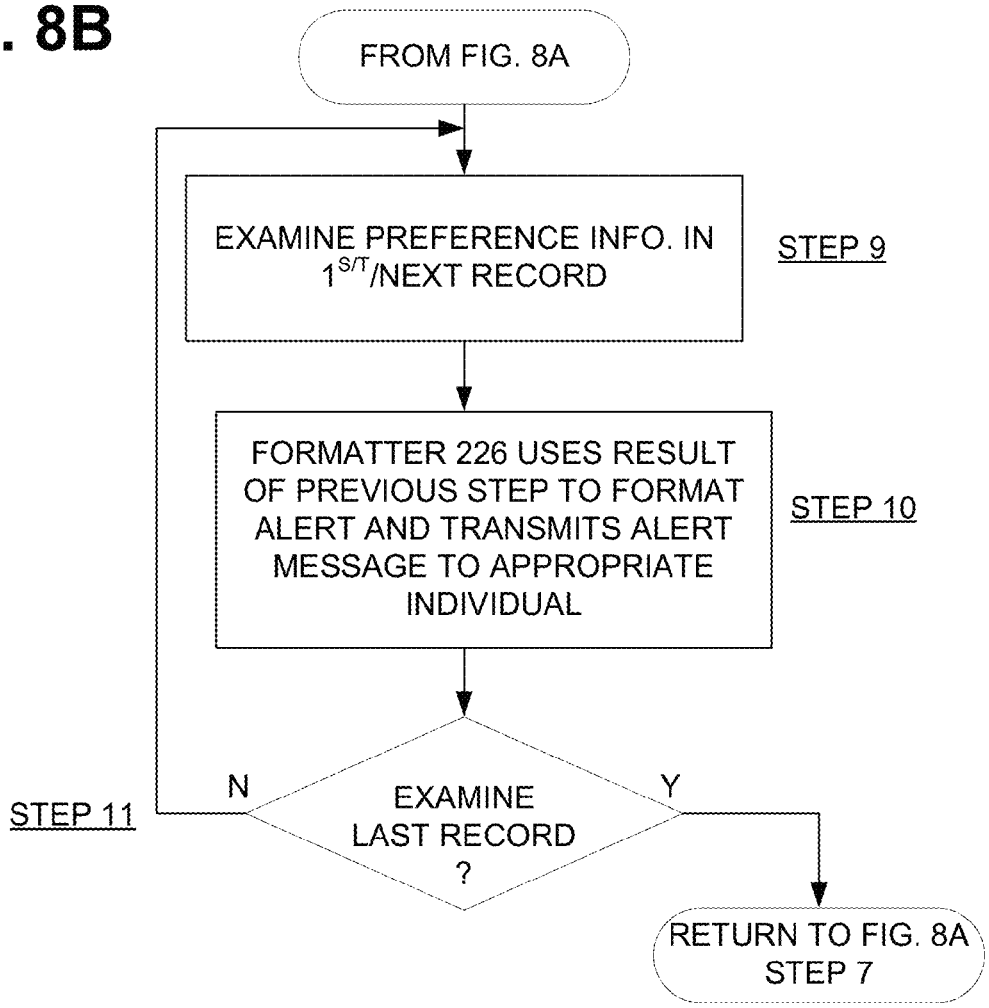

Referring now to Step 9 in FIG. 8B, the logic 216 can examine the preference information in first/next record in the list created in Step 8 to determine, among other things, what language the message should be formatted in. Then in Step 10, the formatter 226 uses the results of Step 9 to generate an alert message and then transmits the alert to the individual associated with the record examined in Step 9. After the last record in the listing (last record identified to have the MC.01 code) is examined by the logic 216, the process can return to Step 7. While the process of generating alert messages in FIGS. 8A and 8B is described to be a serial (i.e., Step 7 to Step 11) process, the process can operate to detect new event messages and to process each message in a parallel processing manner to generate and transmit alert messages.

The forgoing description, for purposes of explanation, used specific nomenclature to provide a thorough understanding of the invention. However, it will be apparent to one skilled in the art that specific details are not required in order to practice the invention. Thus, the forgoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

I claim:

1. A method for generating a mass notification message, comprising:

receiving a mass event message at an event notification system, determining a type of mass event that the message corresponds to and assigning a type code to the mass event message;

identifying, by the event notification system running on a computational device, using the type code assigned to the mass event message, a plurality of individual responder records, each one of the plurality of individual responder records being associated with a different one of the plurality of the individual responders, and each of the individual responder records having individual responder content preference information;

generating, for each one of the plurality of the individual responders, a mass notification message that has content determined by the content preference information associated with each individual responder; and sending the mass notification message, having the content determined by the content preference information, to each one of the plurality of the individual responders.

2. The method of claim 1, wherein the content preference information is specified by each one of the plurality of the individual responders, or is default content preference information not specified by the individual responders, and is one or more of a preferred notification language, a preferred contact information, a preferred communication device or devices, and a preferred content type.

3. The method of claim 2, wherein the preferred content type is one or more of a textual content, audio content, video content, and image content.

4. The method of claim 1, wherein the type code corresponds to a fire emergency, a mass casualty emergency, or a security emergency.

5. The method of claim 1, further comprising each one of the individual responder records maintaining personal information.

6. The method of claim 5, wherein the personal information maintained in one or more of the individual responder records comprises a current duty status and a current location and rate of movement of an individual responder.

7. The method of claim 6, wherein the personal information maintained in one or more of the individual responder records is used by the event notification system to determine whether or not to send an alert message.

8. The method of claim 6, wherein the personal information maintained in one or more of the individual responder records is used by the event notification system to determine what type of content to include in the alert message.

9. A method for generating a mass event notification message, comprising:

receiving a mass event message at an event notification system and detecting information in the mass event message that is used to identify a plurality of individuals qualified to respond to an event associated with the mass event message;

examining by the event notification system running on a computational device, individual responder content preference information in a responder record associated with each of the identified plurality of individuals, and using the content preference information to generate, for each one of the plurality of the identified individual responders, a mass notification message that has content determined by the content preference information associated with each individual responder; and sending the mass notification message having the content determined by the content preference information to each one of the identified plurality of the individual responders.

10. The method of claim 9, wherein the content preference information is specified by each one of the plurality of the individual responders, or is default content preference information not specified by an individual responder, and is one or more of a preferred notification language, a preferred contact information, a preferred communication device or devices, and a preferred content type.

11. The method of claim 10, wherein the preferred content type is one or more of a textual content, audio content, video content, and image content.

12. The method of claim 9, wherein the information in the mass event message that is used to identify the plurality of individuals qualified to respond to the mass event is a mass event type code.

13. The method of claim 9, wherein the content preference information specified by each one of the plurality of the identified individual responders is maintained in a separate individual responder record.

14. The method of claim 13, wherein each one of the individual responder records comprises personal information.

15. The method of claim 14, wherein the personal information maintained in one or more of the individual responder records comprises a current duty status and a current location and rate of movement of an individual responder.

16. The method of claim 15, wherein the personal information maintained in the one or more of the individual responder records is used by the event notification system to determine whether or not to send an alert message.

17. The method of claim 14, wherein the personal information maintained in the one or more of the individual responder records is used by the event notification system to determine what type of content to include in the alert message.

18. A system for generating a mass event notification message, comprising:

a plurality of communication devices each one or which is operated by an individual responder; and a computational device connected to a network having an event notification system that operates to receive a mass event message from a mass event generation device and using information in the mass event message to determine that a mass notification message is to be sent to the individual responders each one or more of which individual responders specifies preferences that the computation device uses to determine what content to include in the mass alert message that is generated for each one of the plurality of the individual responders, and sending the mass notification message to the communication device operated by each one of the plurality of the individual responders.

* * * * *